US010522924B2

(12) United States Patent
Huang et al.

(10) Patent No.: US 10,522,924 B2
(45) Date of Patent: Dec. 31, 2019

(54) ELECTRICAL RECEPTACLE CONNECTOR

(71) Applicant: ADVANCED-CONNECTEK INC., New Taipei (TW)

(72) Inventors: Fan-Cheng Huang, New Taipei (TW); Ying-Te Lin, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 16/130,395

(22) Filed: Sep. 13, 2018

(65) Prior Publication Data

US 2019/0089077 A1 Mar. 21, 2019

(30) Foreign Application Priority Data

Sep. 18, 2017 (TW) ..... 106213892 U

(51) Int. Cl.

| | |
|---|---|
| ***H01R 24/60*** | (2011.01) |
| ***H01R 12/71*** | (2011.01) |
| ***H01R 12/72*** | (2011.01) |
| ***H01R 13/502*** | (2006.01) |
| ***H01R 13/405*** | (2006.01) |
| ***H01R 13/516*** | (2006.01) |
| *H01R 107/00* | (2006.01) |
| *H01R 13/6581* | (2011.01) |

(52) U.S. Cl.

CPC ..... *H01R 12/716* (2013.01); *H01R 12/724* (2013.01); *H01R 13/405* (2013.01); *H01R 13/502* (2013.01); *H01R 13/516* (2013.01); *H01R 13/6581* (2013.01); *H01R 24/60* (2013.01); *H01R 2107/00* (2013.01)

(58) Field of Classification Search

CPC ..... A47G 27/0418; E04F 11/175; E04F 2011/0203; A47C 31/06; E04G 21/30; A44B 17/004

See application file for complete search history.

(56) References Cited

U.S. PATENT DOCUMENTS

| | | | | |
|---|---|---|---|---|
| 9,728,916 | B1 * | 8/2017 | Tsai | H01R 24/60 |
| 9,735,511 | B2 * | 8/2017 | Kao | H01R 13/5202 |
| 9,761,973 | B2 * | 9/2017 | Tsai | H01R 12/716 |
| 9,847,595 | B2 * | 12/2017 | Tsai | H01R 13/521 |
| 9,905,946 | B2 * | 2/2018 | Tsai | H01R 12/57 |

(Continued)

*Primary Examiner* — Truc T Nguyen

(74) *Attorney, Agent, or Firm* — Muncy, Geissler, Olds & Lowe, P.C.

(57) ABSTRACT

An electrical receptacle connector includes a insulated block, first receptacle terminals, second receptacle terminals, an insulated housing, and a metallic shell. A first surface of the insulated block includes a plurality of first engaging grooves for holding the first receptacle terminals, and a second surface of the insulated block includes a plurality second engaging grooves. Accordingly, when the insulated block is formed in a first molding procedure, the first receptacle terminals and the second receptacle terminals are respectively positioned on the insulated block. Next, a second molding procedure is applied to form the insulated housing out of the insulated block. Therefore, the difficulties in manufacturing the components of the connector and the cost for manufacturing the connector can be reduced, while the manufacturing efficiency of the connector can be improved.

19 Claims, 8 Drawing Sheets

(56) References Cited

U.S. PATENT DOCUMENTS

| | | | | |
|---|---|---|---|---|
| 2010/0322570 | A1* | 12/2010 | Zheng | G02B 6/32 385/93 |
| 2011/0103752 | A1* | 5/2011 | Little | G02B 6/32 385/93 |
| 2015/0303610 | A1* | 10/2015 | Hou | H01R 24/62 439/660 |
| 2015/0303623 | A1* | 10/2015 | Kao | H01R 13/6583 439/607.04 |
| 2015/0340791 | A1* | 11/2015 | Kao | H01R 24/60 439/676 |
| 2016/0006195 | A1* | 1/2016 | Zhao | H01R 13/405 439/676 |
| 2016/0064869 | A1* | 3/2016 | Yu | H01R 24/60 439/607.05 |
| 2016/0099526 | A1* | 4/2016 | Chen | H01R 13/5045 439/607.05 |
| 2016/0156136 | A1* | 6/2016 | Kao | H01R 13/6585 439/607.05 |
| 2016/0181722 | A1* | 6/2016 | Tsai | H01R 13/5202 439/587 |
| 2016/0344122 | A1* | 11/2016 | Kao | H01R 12/722 |
| 2016/0352051 | A1* | 12/2016 | Tsai | H01R 13/405 |
| 2017/0110817 | A1* | 4/2017 | Tsai | H01R 12/716 |
| 2018/0062319 | A1* | 3/2018 | Chang | H01R 13/646 |

* cited by examiner

ELECTRICAL RECEPTACLE CONNECTOR

CROSS-REFERENCE TO RELATED APPLICATION

This non-provisional application claims priority under 35 U.S.C. § 119(a) to patent application Ser. No. 10/621,3892 in Taiwan, R.O.C. on Sep. 18, 2017, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core. In general, the plastic core of the conventional connector is formed by several pieces of plastic components, while the upper and lower receptacle terminals are respectively assembled with the plastic components.

SUMMARY OF THE INVENTION

In manufacturing the conventional USB type-C connector, the upper terminals are insert molded with a positioning block, and the lower terminals are insert molded with a plastic core along with a shielding plate, respectively. Next, the molded upper terminals are stacked on the molded lower terminals for a third insert molding procedure, i.e., forming the insulated housing. Accordingly, the semi-product of the conventional connector can be produced. However, in such manufacturing process, three different insert-molding molds are used. Moreover, after the upper terminals and the lower terminals are respectively molded, the molded components have to be stacked for a further third molding, thereby leading the complexity of the manufacturing process, and requiring a higher accuracy in the manufacturing process. As a result, the defect rate and the cost for manufacturing the conventional connector are higher, and the efficiency for manufacturing the conventional connector is adversely affected. Therefore, how to solve these problems is an issue.

In view of this, an embodiment of the instant disclosure provides an electrical receptacle connector. The electrical receptacle connector comprises an insulated block, a plurality of first receptacle terminals, a plurality of second receptacle terminals, an insulated housing, and a metallic shell. A first surface of the insulated block comprises a plurality of first engaging grooves. A second surface of the insulated block comprises a plurality of second engaging grooves. Each of the first receptacle terminals is in the corresponding first engaging groove, and each of the second receptacle terminals is in the corresponding second engaging groove. The insulated housing is formed on the outside of the insulated block. The insulated housing comprises a base portion and a tongue portion. The base portion is extending from one side of the base portion. Each of the first receptacle terminals is held in the base portion and disposed at an upper surface of the tongue portion, and each of the second receptacle terminals is held in the base portion and disposed at a lower surface of the tongue portion. The metallic shell comprises a receptacle cavity, and the insulated housing is received in the receptacle cavity.

In one embodiment, the insulated block comprises a plurality of first engaging blocks outwardly protruding from the first surface and a plurality of second engaging blocks outwardly protruding from the second surface. The first engaging blocks are spaced from each other to form the first engaging grooves between the first engaging blocks, and the second engaging blocks are spaced from each other to form the second engaging grooves between the second engaging blocks.

In one embodiment, each of the first receptacle terminals comprises a flat contact portion, a body portion, and a tail portion. The body portions are held in the first engaging grooves, respectively. Each of the flat contact portions is extending from one of two ends of the corresponding body portion and attached on the first surface of the insulated block, and each of the tail portions is extending from the other end of the corresponding body portion and protruding out of a rear portion of the base portion.

In one embodiment, each of the second receptacle terminals comprises a flat contact portion, a body portion, and a tail portion. The body portions are held in the second engaging grooves, respectively. Each of the flat contact portions is extending from one of two ends of the corresponding body portion and attached on the second surface of the insulated block, and each of the tail portions is extending from the other end of the corresponding body portion and protruding out of the rear portion of the base portion.

In one embodiment, a plurality of first abutting blocks and a plurality of second abutting blocks are extending from one end of the insulated block. The first abutting blocks are abutted against bottoms of front ends of the first receptacle terminals, and the second abutting blocks are abutted against bottoms of front ends of the second receptacle terminals.

In one embodiment, the electrical receptacle connector further comprises a shielding plate. The shielding plate is between the first receptacle terminals and the second receptacle terminals.

In one embodiment, a plurality of hooks is respectively extending from two sides of a front end of the shielding plate. The hooks are respectively protruding from two sides of a front end of the tongue portion. Front ends of the first receptacle terminals and front ends of the hooks have a distance in a horizontal direction, respectively, and front ends of the second receptacle terminals and the front ends of the hooks have a distance in the horizontal direction, respectively.

In one embodiment, the insulated housing comprises a plurality of first recesses and a plurality of second recesses. The first recesses are respectively formed on the upper surface of the tongue portion and respectively at two sides of the first receptacle terminals. The second recesses are respectively formed on the lower surface of the tongue portion and respectively at two sides of the second receptacle terminals.

In one embodiment, the insulated housing comprises a plurality of first side walls and a plurality of second side walls. The first side walls are respectively formed in the first recesses, and each of the first side walls is abutted against a side portion of the corresponding first receptacle terminal. The second side walls are respectively formed in the second recesses, and each of the second side walls is abutted against a side portion of the corresponding second receptacle terminal.

In one embodiment, the first receptacle terminals comprise a plurality of signal terminals, at least one power terminal, and at least one ground terminal, and the second receptacle terminals comprises a plurality of signal terminals, at least one power terminal, and at least one ground terminal.

As above, when the insulated block is formed in the first molding procedure, the first receptacle terminals are positioned on the first surface of the insulated block and the second receptacle terminals are positioned on the second surface of the insulated block. After the receptacle terminals are assembled with the insulated block, the assembly is placed in the mold for a second molding procedure, so that the insulated housing is formed on the outside of the insulated block, and a semi-product of the connector can be thus obtained. As compared with the conventional, the molding times for the connector can be reduced. Therefore, the difficulties in manufacturing the components of the connector and the cost for manufacturing the connector can be reduced, while the manufacturing efficiency of the connector can be improved. Moreover, in the second molding procedure, the first receptacle terminals and the second receptacle terminals are molded by the insulated housing. Therefore, the front ends of the receptacle terminals would not deflect upwardly when the connector is used for a period of time. Furthermore, the insulated block is adapted to separate the first receptacle terminals, the second receptacle terminals, and the shielding plate to prevent interferences between the components.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
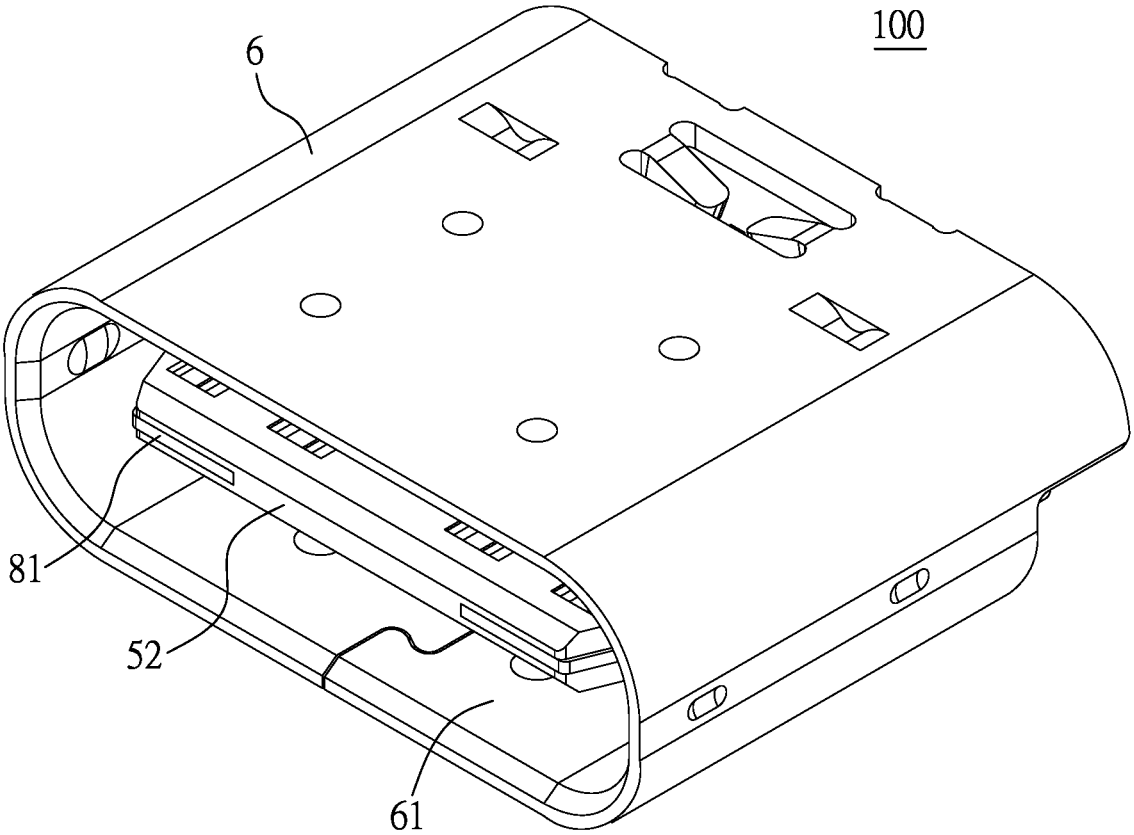
FIG. 1 illustrates a perspective view of an electrical receptacle connector of an exemplary embodiment of the instant disclosure.
Figure 2:
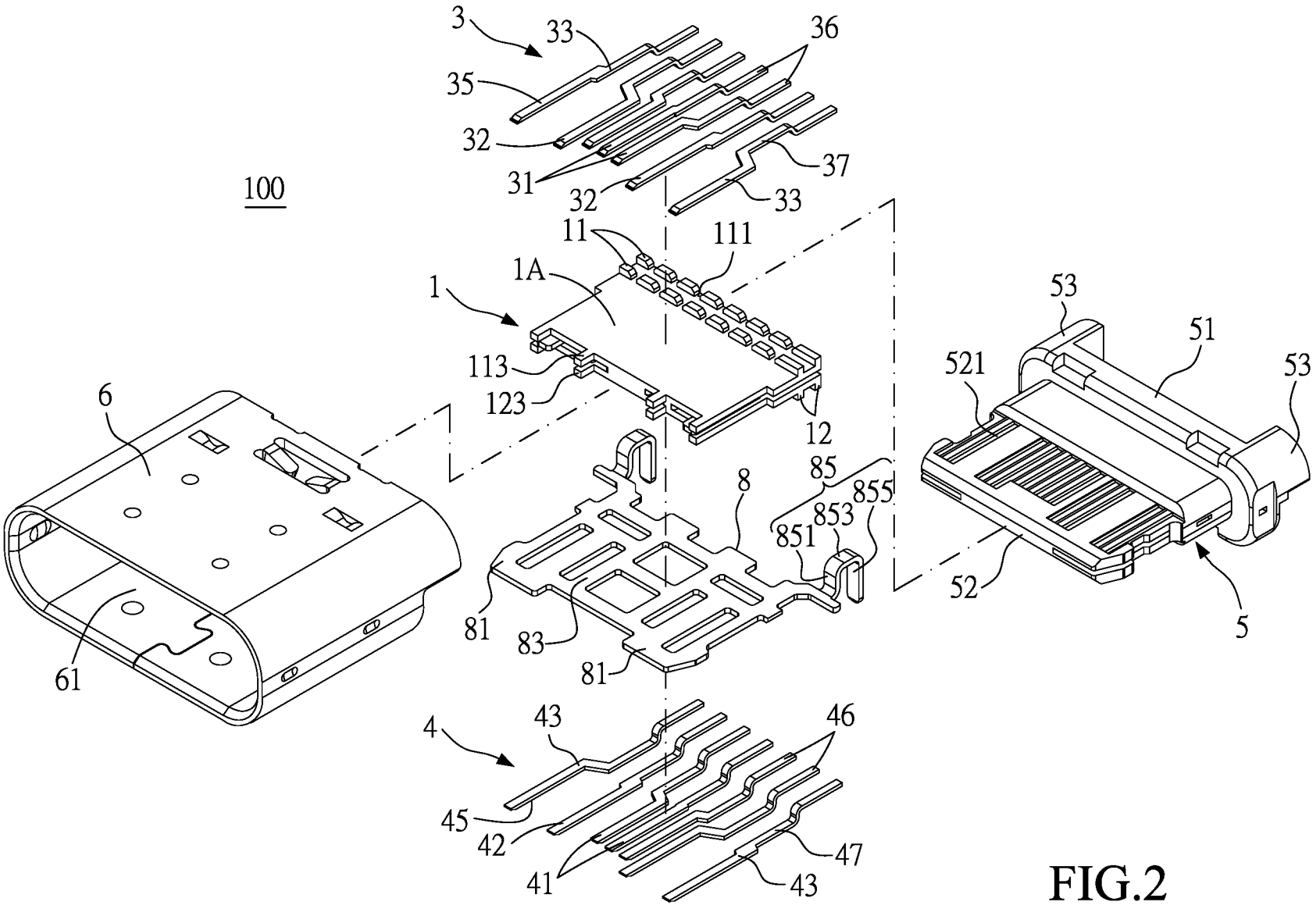
FIG. 2 illustrates an exploded view of the electrical receptacle connector.
Figure 3:
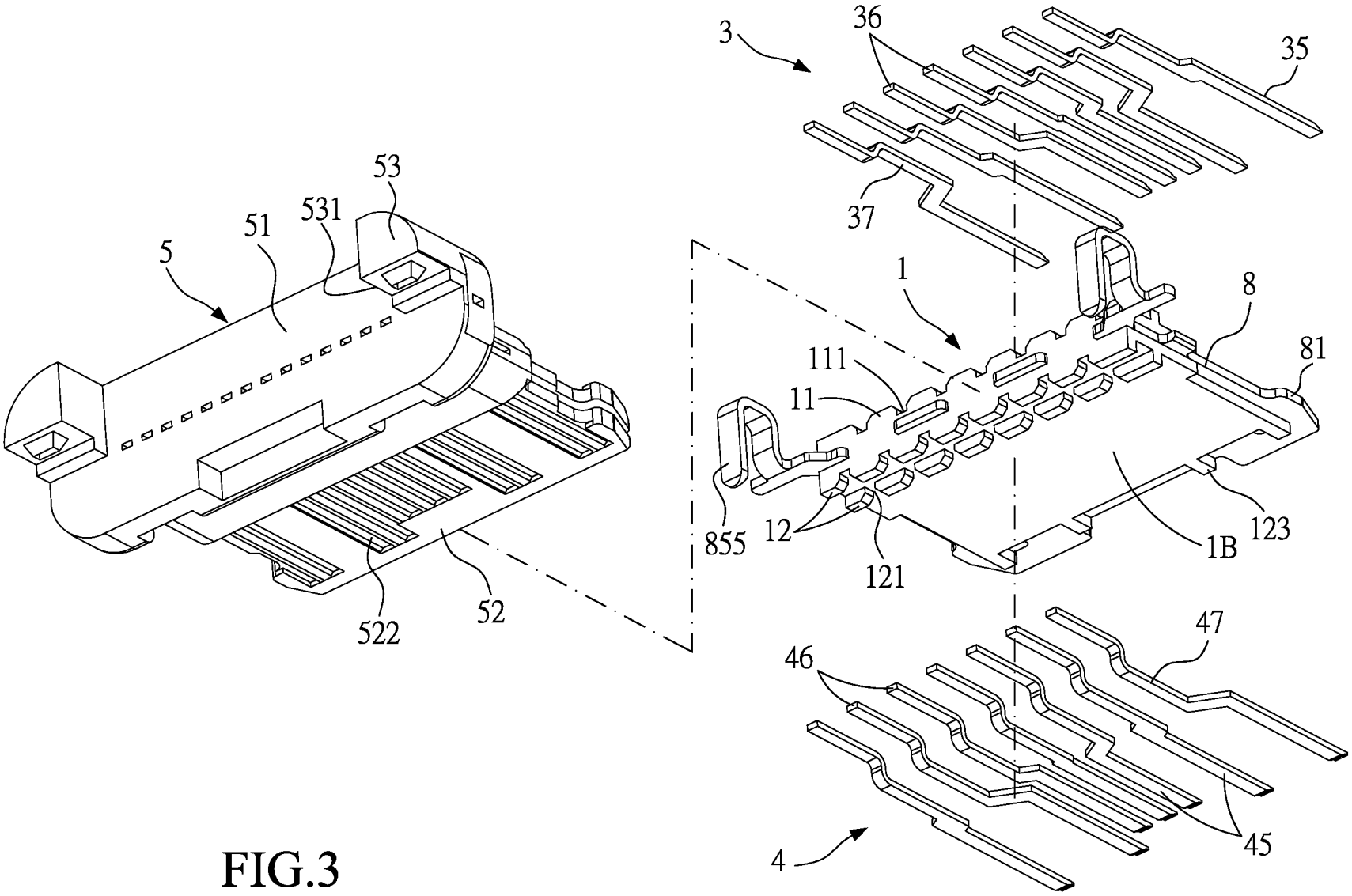
FIG. 3 illustrates a partial exploded view of the electrical receptacle connector.

Please refer to FIGS. 1 and 3, illustrating an electrical receptacle connector 100 of an exemplary embodiment of the instant disclosure. FIG. 1 illustrates a perspective view of an electrical receptacle connector 100 of the exemplary embodiment of the instant disclosure. FIG. 2 illustrates an exploded view of the electrical receptacle connector 100. FIG. 3 illustrates a partial exploded view of the electrical receptacle connector 100. In this embodiment, the terminal numbers of the electrical receptacle connector 100 meets the requirements for transmitting USB 2.0 signals, but embodiments are not limited thereto. In one embodiment, the terminal numbers of the electrical receptacle connector 100 may be adapted to meet the requirements for transmitting USB 3.0 signals, so that the electrical receptacle connector 100 is in accordance with the specification of a USB connection interface. In this embodiment, the electrical receptacle connector 100 comprises an insulated block 1, a plurality of first receptacle terminals 3, a plurality of second receptacle terminals 4, an insulated housing 5, and a metallic shell 6.

Figure 4:
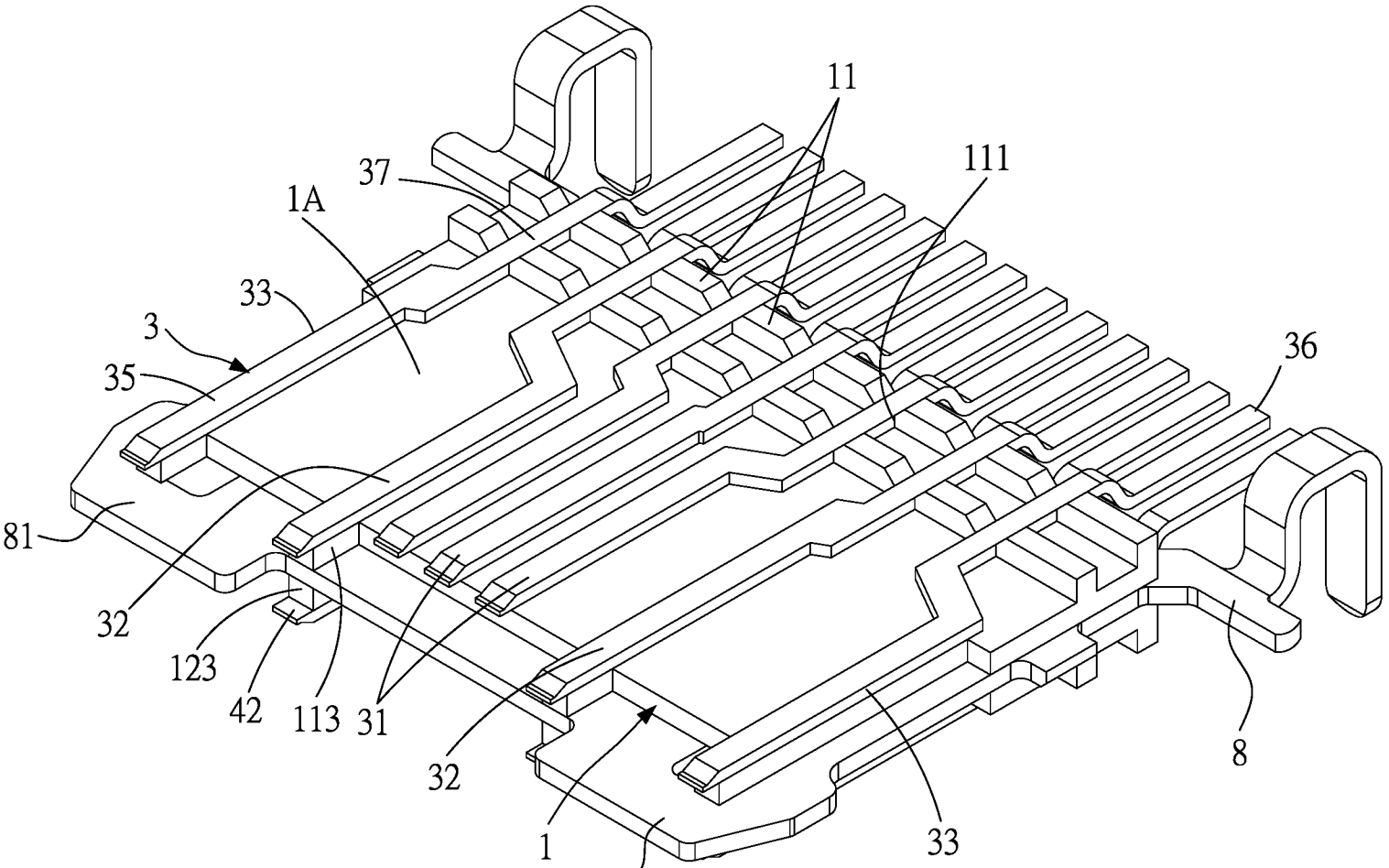
FIG. 4 illustrates a perspective view showing that receptacle terminals are stacked on an insulated block.

Please refer to FIGS. 1 to 4. FIG. 4 illustrates a perspective view showing that receptacle terminals 3, 4 are stacked on the insulated block 1. In other words, in FIG. 4, the insulated block 1 is formed by a first molding procedure, and then the first receptacle terminals 3 and the second receptacle terminals 4 are respectively assembled at upper and lower portions of the insulated block 1. In this embodiment, the insulated block 1 is formed by the first molding procedure. The insulated block 1 is a rectangular plastic body, and an upper surface and a lower surface of the insulated block 1 are flat. A first surface 1A of the insulated block 1 (i.e., the upper surface of the insulated block 1 in FIG. 4) comprises a plurality of first engaging grooves 111, and a second surface 1B of the insulated block 1 (i.e., the lower surface of the insulated block 1 in FIG. 4) comprises a plurality of second engaging grooves 121.

Please refer to FIGS. 1 to 3. In this embodiment, the insulated block 1 comprises a plurality of first engaging blocks 11 and a plurality of second engaging blocks 12. The first engaging blocks 11 are outwardly protruding from the first surface 1A along a vertical direction, and the second engaging blocks 12 are outwardly protruding from the second surface 1B along the vertical direction. The first engaging blocks 11 are spaced from each other to form the first engaging grooves 111 between the first engaging blocks 11, and the second engaging blocks 12 are spaced from each other to form the second engaging grooves 121 between the second engaging blocks 12. As illustrated in FIGS. 2 to 3, the first engaging blocks 11 are arranged in two rows along a front-to-back direction perpendicular to the vertical direction and the second engaging blocks 12 are arranged in two rows along the front-to-back direction perpendicular to the vertical direction. Each row of the first engaging blocks 11 are arranged in a straight line along a transverse direction perpendicular to both the front-to-back direction and the vertical direction. Each row of the second engaging blocks 12 are arranged in a straight line along the transverse direction perpendicular to both the front-to-back direction and the vertical direction.

Please refer to FIGS. 1 to 3. The first receptacle terminals 3 comprise a plurality of first signal terminals 31, at least one power terminal 32, and at least one ground terminal 33. The first receptacle terminals 3 are in the first engaging grooves 111, respectively. In this embodiment, the first receptacle terminals 3 are connected with a metallic belt to form a one-piece component for facilitating in stacking the first receptacle terminals 3 on the first surface 1A of the insulated block 1.

Please refer to FIGS. 1 to 3. The second receptacle terminals 4 comprise a plurality of second signal terminals 41, at least one power terminal 42, and at least one ground terminal 43. The second receptacle terminals 4 are in the second engaging grooves 121, respectively. In this embodiment, the second receptacle terminals 4 are connected with a metallic belt to form a one-piece component for facilitating in stacking the second receptacle terminals 4 on the second surface 1B of the insulated block 1.

Please refer to FIGS. 1 to 3. In this embodiment, the insulated housing 5 comprises a base portion 51, a tongue portion 52, and a plurality of assembling blocks 53. The tongue portion 52 is outwardly extending from one side of the base portion 51. The tongue portion 52 has an upper surface and a lower surface opposite to the upper surface. The insulated housing 5 is formed on the outside of the insulated block 1. The first receptacle terminals 3 are held in the base portion 51 and disposed at the upper surface of the tongue portion 52, and the second receptacle terminals 4 are held in the base portion 51 and disposed at the lower surface of the tongue portion 52. The assembling blocks 53 are at the rear side of the base portion 51.

Please refer to FIGS. 1 to 3. In this embodiment, the metallic shell 6 is a hollowed shell. The metallic shell 6 comprises a receptacle cavity 61, and the insulated housing 5 is received in the receptacle cavity 61.

Please refer to FIGS. 1 to 4. In this embodiment, a plurality of first abutting blocks 113 and a plurality of second abutting blocks 123 are extending from one end of the insulated block 1. The first abutting blocks 113 are abutted against bottoms of front ends of the first receptacle terminals 3, and the second abutting blocks 123 are abutted against bottoms of front ends of the second receptacle terminals 4.

Please refer to FIG. 2 and FIGS. 4 to 6. In this embodiment, each of the first receptacle terminals 3 comprises a flat contact portion 35, a body portion 37, and a tail portion 36. The body portions 37 are respectively held in the first engaging grooves 111. The flat contact portion 35 is extending from one of two ends of the body portion 37 and attached on the first surface 1A of the insulated block 1, and the tail portion 36 is extending from the other end of the body portion 37 and protruding out of a rear portion of the base portion 51. The first signal terminals 31 are disposed at the tongue portion 52 and transmitting first signals (namely, USB 2.0 signals). Furthermore, the tail portions 36 are extending from the body portions 37 to form flat legs, named legs manufactured by SMT (surface mounted technology), which can be mounted or soldered on the surface of a printed circuit board by using surface mount technology. Alternatively, the tail portions 36 may be extending downwardly to form vertical legs, named legs manufactured by through-hole technology, which can be inserted into holes drilled in the printed circuit board.

Please refer to FIG. 2 and FIGS. 4 to 6. In this embodiment, each of the second receptacle terminals 4 comprises a flat contact portion 45, a body portion 47, and a tail portion 46. The body portions 47 are respectively held in the second engaging grooves 121. The flat contact portion 45 is extending from one of two ends of the body portion 47 and attached on the second surface 1B of the insulated block 1, and the tail portion 46 is extending from the other end of the body portion 47 and protruding out of the rear portion of the base portion 51. The second signal terminals 41 are disposed at the tongue portion 52 and transmitting second signals (namely, USB 2.0 signals). Furthermore, the tail portions 46 are extending from the body portion 47 to form flat legs, named legs manufactured by SMT (surface mounted technology), which can be mounted or soldered on the surface of a printed circuit board by using surface mount technology. Alternatively, the tail portions 46 may be extending downwardly to form vertical legs, named legs manufactured by through-hole technology, which can be inserted into holes drilled in the printed circuit board. The first receptacle terminals 3 and the second receptacle terminals 4 are substantially parallel with each other.

Please refer to FIG. 2 and FIGS. 4 to 6, from a top view of the receptacle terminals, the alignment may be in an order of a tail portion 36, a tail portion 46, another tail portion 36, and another tail portion 46, or the alignment may be in an order of a tail portion 36, a tail portion 46, another tail portion 46, and another tail portion 36.

Figure 6:
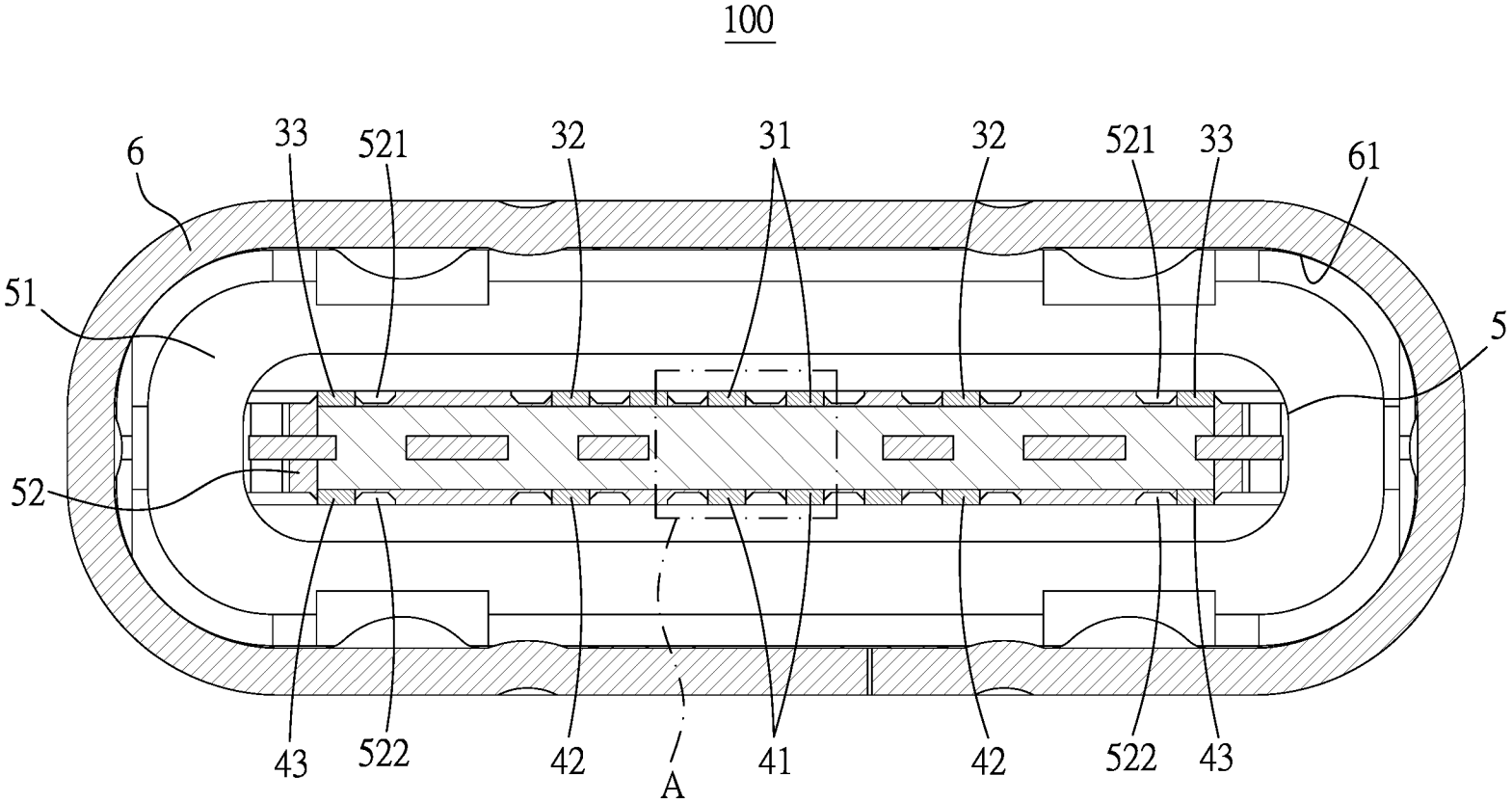
FIG. 6 illustrates a front sectional view of the electrical receptacle connector.

Please refer to FIGS. 2 to 4 and FIG. 6. FIG. 6 illustrates a front sectional view of the electrical receptacle connector. In this embodiment, the first receptacle terminals 3 comprise a plurality of first signal terminals 31, power terminals 32, and ground terminals 33. The first signal terminals 31 comprise a pair of first low-speed signal terminals. In other words, the first receptacle terminals 3 comprise a pair of ground terminals 33 (Gnd), a power terminal 32 (Power/VBUS), a first function detection terminal (CC1/CC2, a terminal for inserting orientation detection of the connector and for cable recognition), a pair of first low-speed signal terminals (D+−, differential signal terminals for low-speed signal transmission), and a first supplement terminal (SBU1/SBU2, a terminal can be reserved for other purposes). In this embodiment, seven first receptacle terminals 31 are provided for transmitting USB 2.0 signals.

Furthermore, in some embodiments, twelve first receptacle terminals 31 are provided for transmitting USB 3.0 signals. From a front view of the first receptacle terminals 3, the first receptacle terminals 3 comprise, from left to right, a ground terminal 33 (Gnd), a first pair of first high-speed signal terminals (TX1+–, differential signal terminals for high-speed signal transmission), a power terminal 32 (Power/VBUS), a first function detection terminal (CC1, a terminal for inserting orientation detection of the connector and for cable recognition), a pair of first low-speed signal terminals (D+–, differential signal terminals for low-speed signal transmission), a first supplement terminal (SBU1, a terminal can be reserved for other purposes), another power terminal 32 (Power/VBUS), a second pair of first high-speed signal terminals (RX2+–, differential signal terminals for high-speed signal transmission), and another ground terminal 33 (Gnd). In this embodiment, each pair of the first high-speed signal terminals is between the corresponding power terminal 32 and the adjacent ground terminal 33, and the pair of the first low-speed signal terminals is between the first function detection terminal and the first supplement terminal.

In some embodiments for transmitting USB 3.0 signals, the rightmost ground terminal 33 (Gnd) (or the leftmost ground terminal 33 (Gnd)) or the first supplement terminal (SBU1) can be further omitted. Therefore, the total number of the first receptacle terminals 3 can be reduced from twelve terminals to seven terminals.

Furthermore, the ground terminal 33 (Gnd) may be replaced by a power terminal 32 (Power/VBUS) and provided for power transmission. In this embodiment, the width of the power terminal 32 (Power/VBUS) may be, but not limited to, equal to the width of the first signal terminal 31. In some embodiments, the width of the power terminal 32 (Power/VBUS) may be greater than the width of the first signal terminal 31 and an electrical receptacle connector 100 having the power terminal 32 (Power/VBUS) can be provided for large current transmission.

Please refer to FIGS. 2 to 4 and FIG. 6. In this embodiment, the second receptacle terminals 4 comprise a plurality of second signal terminals 41, power terminals 42, and ground terminals 43. The second signal terminals 41 comprise a pair of second low-speed signal terminals. In other words, the second receptacle terminals 4 comprise a pair of ground terminals 43 (Gnd), a power terminal 42 (Power/VBUS), a second function detection terminal (CC1/CC2, a terminal for inserting orientation detection of the connector and for cable recognition), a pair of second low-speed signal terminals (D+–, differential signal terminals for low-speed signal transmission), and a second supplement terminal (SBU1/SBU2, a terminal can be reserved for other purposes). In this embodiment, seven second receptacle terminals 41 are provided for transmitting USB 2.0 signals.

Furthermore, in some embodiments, twelve second receptacle terminals 41 are provided for transmitting USB 3.0 signals. From a front view of the second receptacle terminals 4, the second receptacle terminals 4 comprise, from right to left, a ground terminal 43 (Gnd), a first pair of second high-speed signal terminals (TX2+–, differential signal terminals for high-speed signal transmission), a power terminal 42 (Power/VBUS), a second function detection terminal (CC2, a terminal for inserting orientation detection of the connector and for cable recognition), a pair of second low-speed signal terminals (D+–, differential signal terminals for low-speed signal transmission), a second supplement terminal (SBU2, a terminal can be reserved for other purposes), another power terminal 42 (Power/VBUS), a second pair of second high-speed signal terminals (RX1+–, differential signal terminals for high-speed signal transmission), and another ground terminal 43 (Gnd).

In this embodiment, each pair of the second high-speed signal terminals is between the corresponding power terminal 42 and the adjacent ground terminal 43, and the pair of the second low-speed signal terminals is between the second function detection terminal and the second supplement terminal.

In some embodiments for transmitting USB 3.0 signals, the rightmost ground terminal 43 (Gnd) (or the leftmost ground terminal 43 (Gnd)) or the second supplement terminal (SBU1) can be further omitted. Therefore, the total number of the second receptacle terminals 4 can be reduced from twelve terminals to seven terminals.

Furthermore, the ground terminal 43 (Gnd) may be replaced by a power terminal 42 (Power/VBUS) and provided for power transmission. In this embodiment, the width of the power terminal 42 (Power/VBUS) may be, but not limited to, equal to the width of the second signal terminal 41. In some embodiments, the width of the power terminal 42 (Power/VBUS) may be greater than the width of the second signal terminal 41 and an electrical receptacle connector 100 having the power terminal 42 (Power/VBUS) can be provided for large current transmission.

Figure 5:
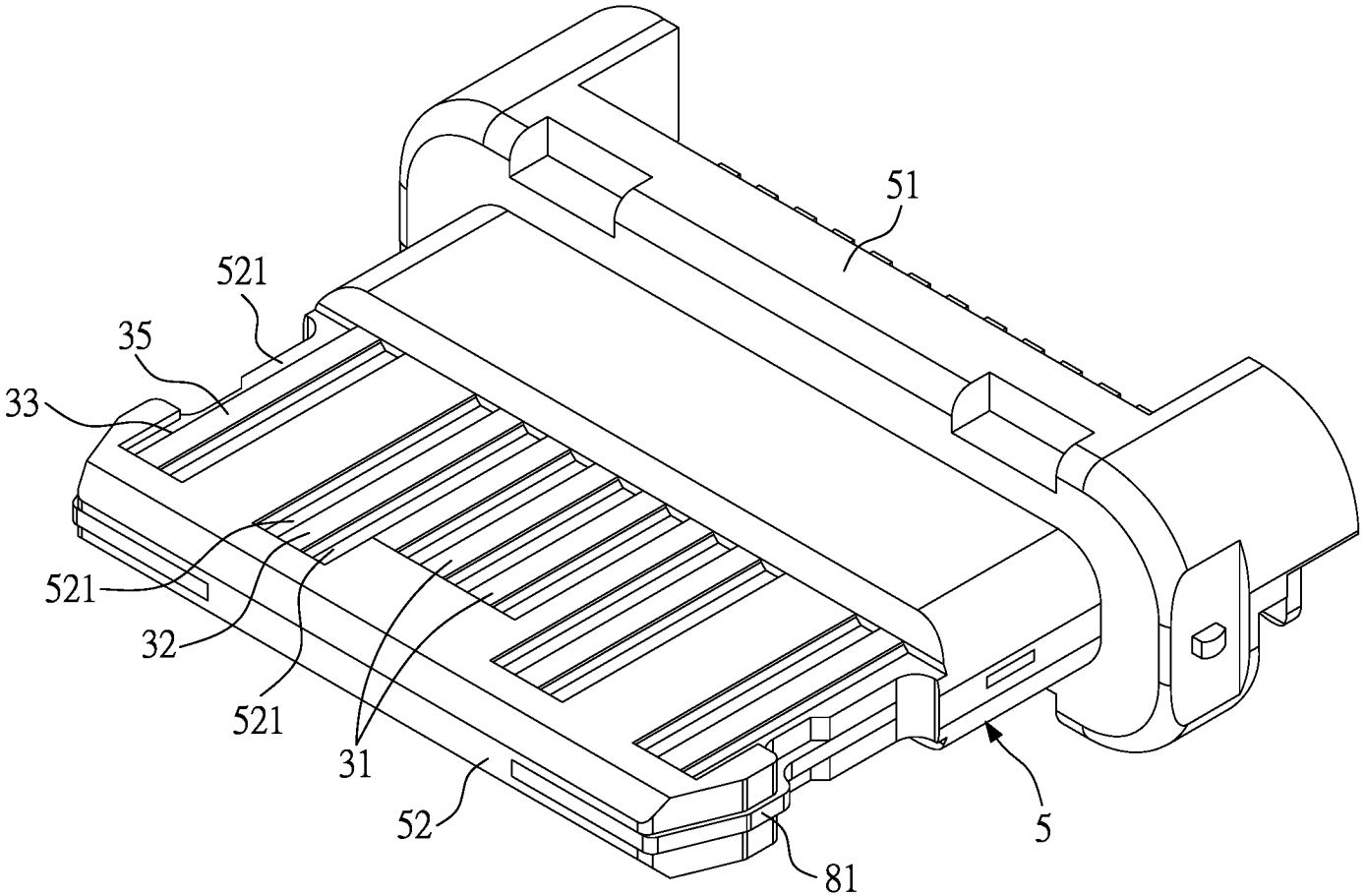
FIG. 5 illustrates a perspective view of an insulated housing of the electrical receptacle connector.
Figure 8:
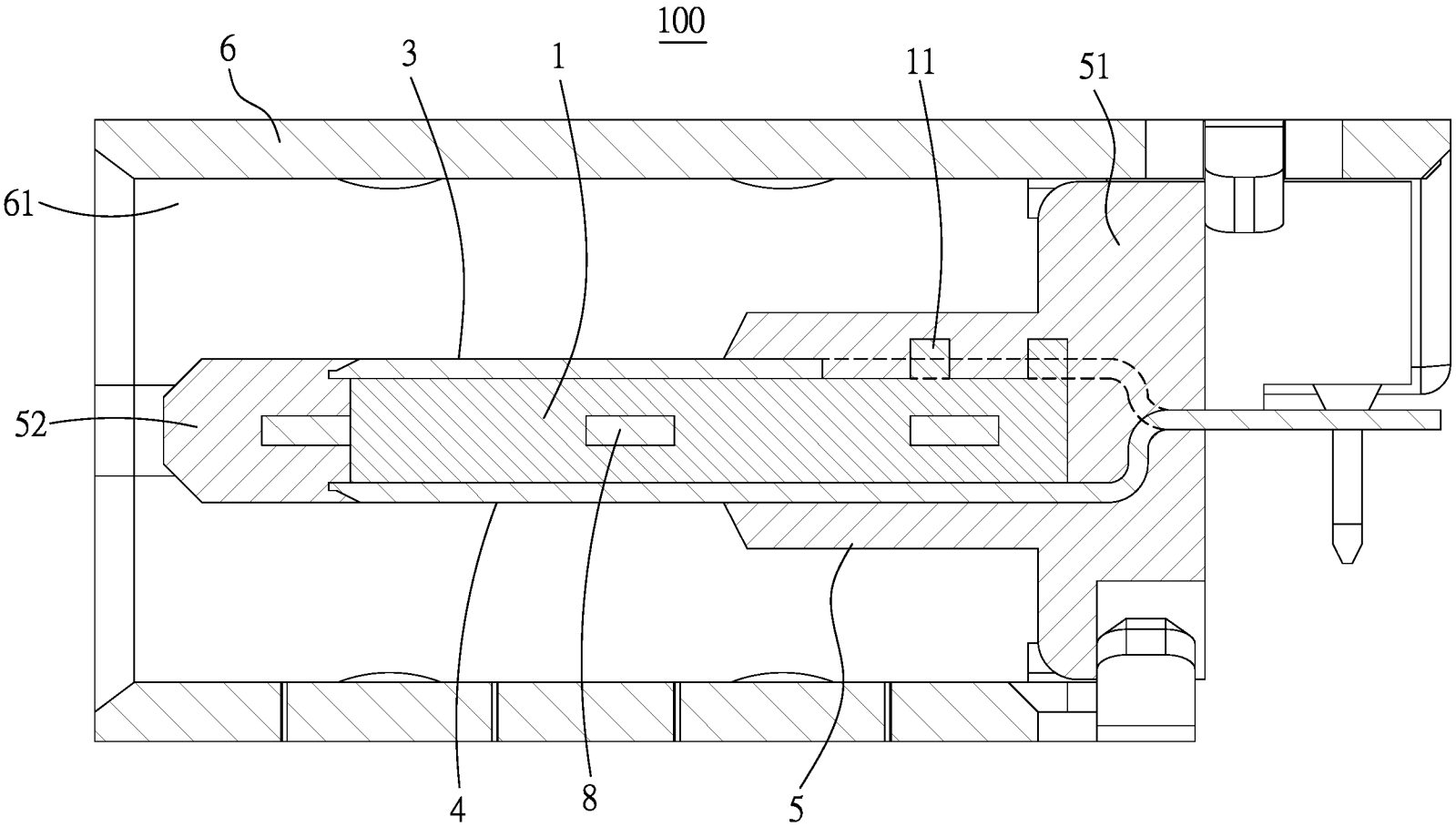
FIG. 8 illustrates a side sectional view of the electrical receptacle connector.

Please refer to FIGS. 2, 5, 6, and 8. FIG. 5 illustrates a perspective view of the insulated housing 5 of the electrical receptacle connector. FIG. 8 illustrates a side sectional view of the electrical receptacle connector. In this embodiment, the first receptacle terminals 3 and the second receptacle terminals 4 are disposed upon the upper surface and the lower surface of the tongue portion 52, respectively, and pin-assignments of the first receptacle terminals 3 and the second receptacle terminals 4 are point-symmetrical with a central point of the receptacle cavity 61 of the metallic shell 6 as the symmetrical center. In other words, pin-assignments of the first receptacle terminals 3 and the second receptacle terminals 4 have 180-degree symmetrical design with respect to the central point of the receptacle cavity 61 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 3 (or the second receptacle terminals 4), are rotated by 180 degrees with the symmetrical center as the rotating center, the first receptacle terminals 3 and the second receptacle terminals 4 are overlapped. That is, the rotated first receptacle terminals 3 are arranged at the position of the original second receptacle terminals 4, and the rotated second receptacle terminals 4 are arranged at the position of the original first receptacle terminals 3. In other words, the first receptacle terminals 3 and the second receptacle terminals 4 are arranged upside down, and the pin assignments of the first receptacle terminals 3 are left-right reversal with respect to that of the second receptacle terminals 4. An electrical plug connector is inserted into the electrical receptacle connector 100 with a first orientation where the upper surface of the tongue portion 52 is facing up, for transmitting first signals. Conversely, the electrical plug connector is inserted into the electrical receptacle connector 100 with a second orientation where the upper surface of the tongue portion 52 is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 3 (or the second receptacle terminals 4) when an electrical plug connector to be mated with the electrical receptacle connector 100 has upper and lower plug terminals. In the case that the first receptacle terminals 3 are omitted, the upper plug terminals or the lower plug terminals of the electrical plug connector are in contact with the second receptacle terminals 4 of the electrical receptacle connector 100 when the electrical plug connector is inserted into the electrical receptacle connector 100 with the dual orientations. Conversely, in the case that the second receptacle terminals 4 are omitted, the upper plug terminals or the lower plug terminals of the electrical plug connector are in contact with the first receptacle terminals 3 of the electrical receptacle connector 100 when the electrical plug connector is inserted into the electrical receptacle connector 100 with the dual orientations.

Please refer to FIGS. 2, 5, 6, and 8. In this embodiment, as viewed from the front of the receptacle terminals 3, 4, the position of the first receptacle terminals 3 corresponds to the position of the second receptacle terminals 4. In other words, the positions of the flat contact portions 35 are respectively aligned with the positions of the flat contact portions 45, but embodiments are not limited thereto. In some embodiments, the first receptacle terminals 3 may be aligned by an offset with respect to the second receptacle terminals 4. That is, the flat contact portions 35 are aligned by an offset with respect to the flat contact portions 45. Accordingly, because of the offset alignment of the flat contact portions 35, 45, the crosstalk between the first receptacle terminals 3 and the second receptacle terminals 4 can be reduced during signal transmission. It is understood that, when the receptacle terminals 3, 4 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 3, 4 of the electrical receptacle connector 100 for power or signal transmission.

Please refer to FIG. 2 and FIGS. 4 to 6. In this embodiment, the electrical receptacle connector 100 further comprises a shielding plate 8. The shielding plate 8 comprises a plate body 83 and a plurality of legs 85. In the first molding procedure, the plate body 83 is molded and disposed in the insulated block 1. The two legs 85 are protruded out of the insulated block 1. The plate body 83 is between the first receptacle terminals 3 and the second receptacle terminals 4. Each of the soldering legs 85 comprises a first extending portion 851, a connecting portion 853, and a second extending portion 855. The first extending portion 851 is extended outwardly from the plate body 83. The connecting portion 853 is connecting between the first extending portion 851 and the second extending portion 855. The second portion 855 is extended downwardly from the connecting portion 853. After the second molding procedure, the plate body 83 and the insulated block 1 are disposed in the tongue portion 52, and the first extending portion 851 and the connecting portion 853 are in the assembling block 83, and the second extending portion 855 is protruded out of the assembling block 53. The plate body 83 is between the flat contact portions 35 of the first receptacle terminals 3 and the flat contact portions 45 of the second receptacle terminals 4. Specifically, the plate body 83 may be lengthened and widened, so that the front of the plate body is near a front lateral surface of the tongue portion 52, two sides of the plate body 83 is near two sides of the tongue portion 52 for contacting an electrical plug connector, and the rear of the plate body 83 is near the rear of the tongue portion 52. Accordingly, the plate body 83 can be disposed on the tongue portion 52 and the base portion 51, and the structural strength of the tongue portion 52 and the shielding performance of the tongue portion 52 can be improved.

Please refer to FIGS. 2 to 5. The second extending portion 855 of the legs 85 of the shielding plate 8 are downwardly extending from the rear portion of the plate body 83 to form vertical legs (through-hole legs). That is, the legs 85 are exposed from the assembling block 53 and soldered with a circuit board. In this embodiment, the crosstalk interference can be reduced by the shielding of the shielding plate 8 when the flat contact portions 35, 45 transmit signals. Furthermore, the structural strength of the tongue portion 52 can be improved by the assembly of the shielding plate 8. In addition, the legs 85 of the shielding plate 8 are exposed from the base portion 51 and soldered with the circuit board for conduction and grounding.

Please refer to FIGS. 2 to 5. The shielding plate 8 further comprises a plurality of hooks 81. The hooks 81 are extending outwardly from two sides of the front portion of the plate body 83 and protruding from the front lateral surface and two sides of the tongue portion 52. In other words, the hooks 81 are respectively outwardly protruding from two sides of the front portion of the shielding plate 8, and the hooks 81 are protruding from the two sides of the front portion of the tongue portion 52. A front end of the first receptacle terminal 3 above the hook 81 is spaced from a front end of the hook 81 by a distance, and a front end of the second receptacle terminal 4 below the hook 81 is spaced from a front end of the hook 81 by a distance. In other words, the front ends of the first receptacle terminals 3 and the front ends of the respective hooks 81 have a distance in a horizontal direction, and the front ends of the second receptacle terminals 4 and the front ends of the respective hooks 81 have a distance in the horizontal direction. That is, the hooks 81 are protruding from the front end of the tongue portion 52, while the front ends of the first receptacle terminals 3 and the front ends of the second receptacle terminals 4 are not protruding from the front end of the tongue portion 52. Therefore, the hooks 81 protect the front end of the tongue portion 52 from being worn after the connector is used for a period of time and the hooks 81 further prevent the front ends of the first receptacle terminals 3 and the front ends of the second receptacle terminals 4 from impacting with each other when the front end of the tongue portion 52 is worn. Furthermore, when an electrical plug connector is mated with the electrical receptacle connector 100, elastic pieces at two sides of an insulated housing of the electrical plug connector are engaged with the hooks 81, and the elastic pieces would not wear against the tongue portion 52 of the electrical receptacle connector 100.

Please refer to FIGS. 1 to 3. It is understood that, when the connector has a number of receptacle terminals adapted to transmit USB 2.0 signals (i.e., transmit low-speed signals) or has a number of receptacle terminals adapted to transmit USB 3.0 signals (i.e., transmit high-speed signals), the connector may comprise the shielding plate 8. When the shielding plate 8 is provided for a connector for USB 3.0 signal transmission, the shielding plate 8 can provide a shielding function to prevent crosstalk between terminals, the shielding plate 8 is also adapted to be engaging with an electrical plug connector, and the shielding plate 8 is further provided for grounding. Conversely, when the shielding plate 8 is provided for a connector for USB 2.0 signal transmission, the shielding plate 8 is adapted to be engaged with an electrical plug connector, and the shielding plate 8 is further provided for grounding.

Figure 7:
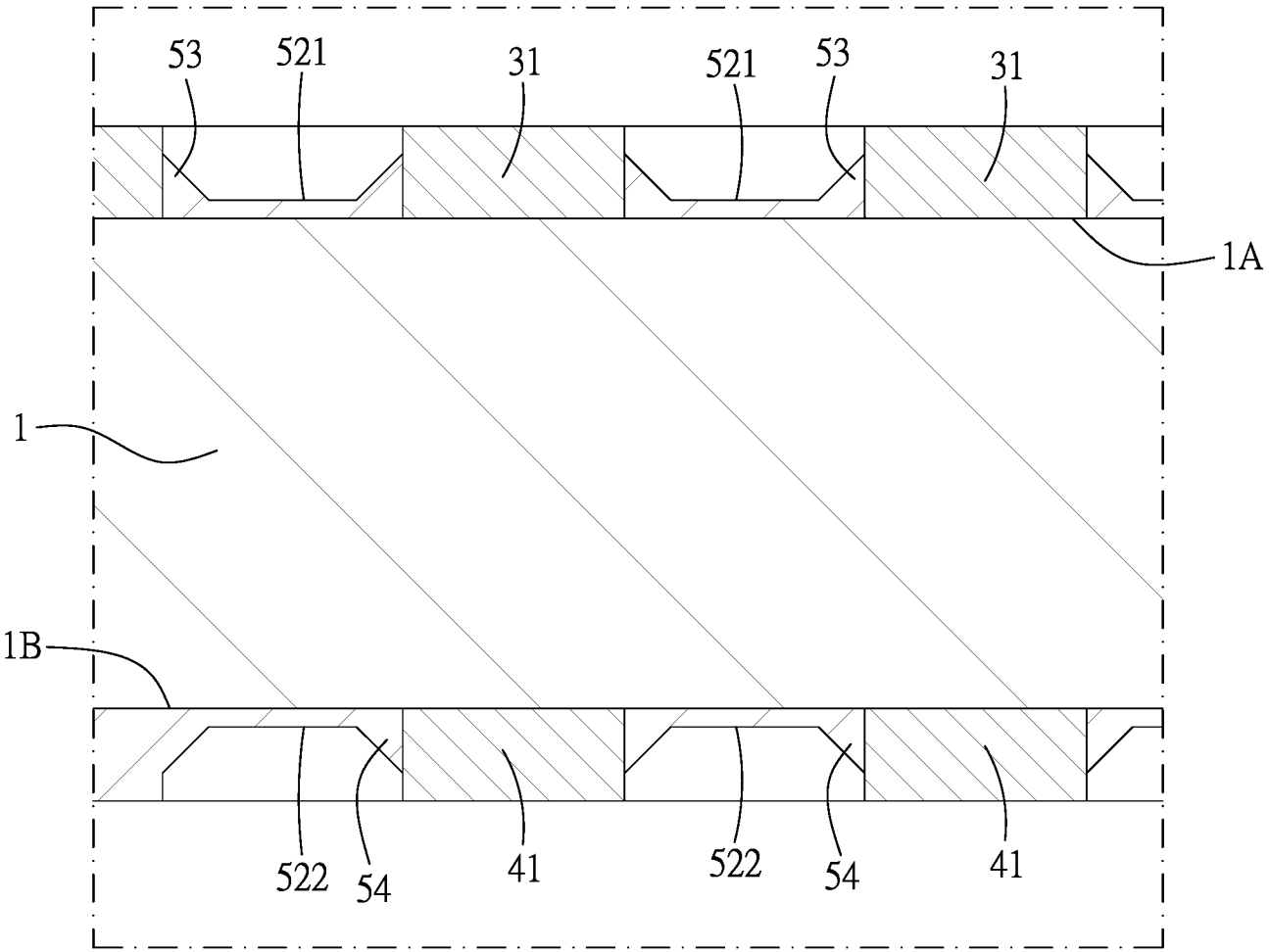
FIG. 7 illustrates a partial enlarged view of the portion A of FIG. 6.

Please refer to FIGS. 2, 3, and 5 to 7. FIG. 7 illustrates a partial enlarged view of the portion A of FIG. 6. The insulated housing 5 is manufactured in the second molding procedure. The insulated housing 5 comprises a plurality of first recesses 521 and a plurality of second recesses 522. The first recesses 521 are formed on the upper surface of the tongue portion 52 and respectively at two sides of the first receptacle terminals 3. The second recesses 522 are formed on the lower surface of the tongue portion 52 and respectively at two sides of the second receptacle terminals 4. Wherein, in one embodiment, a plurality of cores in the mold is respectively abutted against the two sides of the first receptacle terminals 3 and the two sides of the second receptacle terminals 4. After the molding procedure, the first recesses 521 and the second recesses 522 are formed.

Please refer to FIGS. 2, 3, and 5 to 7. The insulated housing 5 comprises a plurality of first side walls 53 and a plurality of second side walls 54. The first side walls 53 are respectively formed in the first recesses 521, and each of the first side walls 53 is abutted against a side portion of the corresponding first receptacle terminal 3. The second side walls 54 are respectively formed in the second recesses 522, and each of the second side walls 54 is abutted against a side portion of the corresponding second receptacle terminal 4. In this embodiment, the first side walls 53 form inclined walls at two sides of each of the first recesses 521, and the first side walls 53 are abutted against the side portion of the corresponding first receptacle terminal 3, so that a contact area between the side portion of the first receptacle terminal 3 and the first recess 521 can be increased, and the first receptacle terminals 3 can be firmly attached on the tongue portion 52. In this embodiment, the second side walls 54 form inclined walls at two sides of each of the second recesses 522, and the second side walls 54 are abutted against the side portion of the corresponding second receptacle terminal 4, so that a contact area between the side portion of the second receptacle terminal 4 and the second recess 522 can be increased, and the second receptacle terminals 4 can be firmly attached on the tongue portion 52.

As above, when the insulated block is formed in the first molding procedure, the first receptacle terminals are positioned on the first surface of the insulated block and the second receptacle terminals are positioned on the second surface of the insulated block. After the receptacle terminals are assembled with the insulated block, the assembly is placed in the mold for a second molding procedure, so that the insulated housing is formed on the outside of the insulated block, and a semi-product of the connector can be thus obtained. As compared with the conventional, the molding times for the connector can be reduced. Therefore, the difficulties in manufacturing the components of the connector and the cost for manufacturing the connector can be reduced, while the manufacturing efficiency of the connector can be improved. Moreover, in the second molding procedure, the first receptacle terminals and the second receptacle terminals are molded by the insulated housing. Therefore, the front ends of the receptacle terminals would not deflect upwardly when the connector is used for a period of time. Furthermore, the insulated block is adapted to separate the first receptacle terminals, the second receptacle terminals, and the shielding plate to prevent interferences between the components.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

an insulated block comprising a plurality of first engaging blocks outwardly protruding from a first surface of the insulated block along a vertical direction and a plurality of second engaging blocks outwardly protruding from a second surface of the insulated block along the vertical direction, wherein the first engaging blocks are spaced from each other to form a plurality of first engaging grooves between the first engaging blocks, and the second engaging blocks are spaced from each other to form a plurality of second engaging grooves between the second engaging blocks;

a plurality of first receptacle terminals, each of the first receptacle terminals is disposed between two of the first engaging blocks, and held in the corresponding first engaging groove;

a plurality of second receptacle terminals, each of the second receptacle terminals is disposed between two of the second engaging blocks, and held in the corresponding second engaging groove;

an insulated housing formed on the outside of the insulated block by a molding process, wherein the insulated housing comprises a base portion and a tongue portion, the base portion is extending from one side of the base portion, each of the first receptacle terminals is held in the base portion and disposed at an upper surface of the tongue portion, and each of the second receptacle terminals is held in the base portion and disposed at a lower surface of the tongue portion; and a metallic shell comprising a receptacle cavity, wherein the insulated housing is received in the receptacle cavity.

2. The electrical receptacle connector according to claim 1, wherein each of the first receptacle terminals comprises a flat contact portion, a body portion, and a tail portion, the body portions are held in the first engaging grooves, respectively, each of the flat contact portions is extending from one of two ends of the corresponding body portion and attached on the first surface of the insulated block, and each of the tail portions is extending from the other end of the corresponding body portion and protruding out of a rear portion of the base portion.

3. The electrical receptacle connector according to claim 1, wherein each of the second receptacle terminals comprises a flat contact portion, a body portion and a tail portion, the body portions are held in the second engaging grooves, respectively, each of the flat contact portions is extending from one of two ends of the corresponding body portion and attached on the second surface of the insulated block, and each of the tail portions is extending from the other end of the corresponding body portion and protruding out of a rear portion of the base portion.

4. The electrical receptacle connector according to claim 1, wherein a plurality of first abutting blocks and a plurality of second abutting blocks are extending from one end of the insulated block, the first abutting blocks are abutted against bottoms of front ends of the first receptacle terminals, and the second abutting blocks are abutted against bottom of front ends of the second receptacle terminals.

5. The electrical receptacle connector according to claim 1, further comprising a shielding plate in the insulated block, wherein the shielding plate is between the first receptacle terminals and the second receptacle terminals.

6. The electrical receptacle connector according to claim 1, wherein the insulated housing comprises a plurality of first recesses and a plurality of second recesses, the first recesses are respectively formed on the upper surface of the tongue portion and respectively at two sides of the first receptacle terminals, the second recesses are respectively formed on the lower surface of the tongue portion and respectively at two sides of the second receptacle terminals.

7. The electrical receptacle connector according to claim 1, wherein the first receptacle terminals comprise a plurality of signal terminals, at least one power terminal, and at least one ground terminal, the second receptacle terminals comprise a plurality of signal terminals, at least one power terminal, and at least one ground terminal.

8. The electrical receptacle connector according to claim 1, wherein the insulated block is formed by a first molding procedure and the insulated housing is formed on the outside of the insulated block by a second molding procedure.

9. The electrical receptacle connector according to claim 1, wherein the first engaging blocks are arranged in two rows along a front-to-back direction perpendicular to the vertical direction and the second engaging blocks are arranged in two rows along the front-to-back direction perpendicular to the vertical direction, each row of the first engaging blocks are arranged in a straight line along a transverse direction perpendicular to both the front-to-back direction and the vertical direction, and each row of the second engaging blocks are arranged in a straight line along the transverse direction perpendicular to both the front-to-back direction and the vertical direction.

10. The electrical receptacle connector according to claim 5, a plurality of hooks is respectively extending from two sides of a front end of the shielding plate, the hooks are respectively protruding from two sides of a front end of the tongue portion, front ends of the first receptacle terminals and front ends of the hooks have a distance in a horizontal direction, respectively, and front ends of the second receptacle terminals and the front ends of the hooks have a distance in the horizontal direction, respectively.

11. The electrical receptacle connector according to claim 6, wherein the insulated housing comprises a plurality of first side walls and a plurality of second side walls, the first side walls are respectively formed in the first recesses, and each of the first side walls is abutted against a side portion of the corresponding first receptacle terminal, the second side walls are respectively formed in the second recesses, and each of the second side walls is abutted against a side portion of the corresponding second receptacle terminal.

12. The electrical receptacle connector according to claim 5, wherein the shielding plate is molded in the insulated block by a first molding procedure and the insulated housing is formed on the outside of the insulated block by a second molding procedure.

13. The electrical receptacle connector according to claim 5, wherein the shielding plate comprising a plate body and a plurality of legs, wherein the plate body is in the insulated block, and between the first receptacle terminals and the second receptacle terminals, the legs are extended from the rear side of the plate body, each of the legs comprises a first extending portion, a connecting portion, and a second extending portion, the first extending portion is extended outwardly from the plate body, the connecting portion is connecting between the first extending portion and the second extending portion, the second portion is extended downwardly from the connecting portion.

14. The electrical receptacle connector according to claim 13, wherein the insulated housing further comprising a plurality of assembling blocks at the rear side of the base portion, and the first extending portion and the connecting portion of the legs are in the assembling blocks, and the second extending portion is protruded out of the assembling blocks.

15. An electrical receptacle connector, comprising:

an insulated block comprising a plurality of first engaging blocks outwardly protruding from a first surface of the insulated block along a vertical direction and a plurality of second engaging blocks outwardly protruding from a second surface of the insulated block along the vertical direction, wherein the first engaging blocks are spaced from each other to form a plurality of first engaging grooves between the first engaging blocks, the second engaging blocks are spaced from each other to form a plurality of second engaging grooves between the second engaging blocks, the first engaging blocks are arranged in two rows along a front-to-back direction perpendicular to the vertical direction and the second engaging blocks are arranged in two rows along the front-to-back direction perpendicular to the vertical direction, each row of the first engaging blocks are arranged in a straight line along a transverse direction perpendicular to both the front-to-back direction and the vertical direction, and each row of the second engaging blocks are arranged in a straight line along the transverse direction perpendicular to both the front-to-back direction and the vertical direction;

a plurality of first receptacle terminals, each of the first receptacle terminals is held in the corresponding first engaging grooves in two rows;

a plurality of second receptacle terminals, each of the second receptacle terminals is held in the corresponding second engaging grooves in two rows;

an insulated housing formed on the outside of the insulated block by a molding process, wherein the insulated housing comprises a base portion and a tongue portion, the base portion is extending from one side of the base portion, each of the first receptacle terminals is held in the base portion and disposed at an upper surface of the tongue portion, and each of the second receptacle terminals is held in the base portion and disposed at a lower surface of the tongue portion; and a metallic shell comprising a receptacle cavity, wherein the insulated housing is received in the receptacle cavity.

16. The electrical receptacle connector according to claim 15, wherein each of the first receptacle terminals comprises a flat contact portion, a body portion, and a tail portion, the body portions are held in the first engaging grooves, respectively, each of the flat contact portions is extending from one of two ends of the corresponding body portion and attached on the first surface of the insulated block, and each of the tail portions is extending from the other end of the corresponding body portion and protruding out of a rear portion of the base portion.

17. The electrical receptacle connector according to claim 15, wherein each of the second receptacle terminals comprises a flat contact portion, a body portion and a tail portion, the body portions are held in the second engaging grooves, respectively, each of the flat contact portions is extending from one of two ends of the corresponding body portion and attached on the second surface of the insulated block, and each of the tail portions is extending from the other end of the corresponding body portion and protruding out of a rear portion of the base portion.

18. The electrical receptacle connector according to claim 15, wherein a plurality of first abutting blocks and a plurality of second abutting blocks are extending from one end of the insulated block, the first abutting blocks are abutted against bottoms of front ends of the first receptacle terminals, and the second abutting blocks are abutted against bottom of front ends of the second receptacle terminals.

19. The electrical receptacle connector according to claim 15, further comprising a shielding plate in the insulated block, wherein the shielding plate is between the first receptacle terminals and the second receptacle terminals.

* * * * *